US005414410A

United States Patent [19]

Davies et al.

[11] Patent Number: 5,414,410

[45] Date of Patent: May 9, 1995

[54] METHOD AND SYSTEM FOR DETECTING A MARKER

[75] Inventors: Daffyd G. Davies; Andrew Dames; Michael D. Crossfield, all of Cambridge, United Kingdom

[73] Assignee: Esselte Meto International GmbH, Heppenheim, Germany

[21] Appl. No.: 194,285

[22] Filed: Feb. 10, 1994

[30] Foreign Application Priority Data

Feb. 11, 1993 [GB] United Kingdom ..... 9302757

[51] Int. Cl.[6] ..... G08B 13/187

[52] U.S. Cl. ..... 340/551; 340/572

[58] Field of Search ..... 340/551, 572

[56] References Cited

U.S. PATENT DOCUMENTS 3,990,065 11/1976 Purinton et al. ..... 340/572
4,622,542 11/1986 Weaver ..... 340/551
4,710,752 12/1987 Cordery ..... 340/572
5,121,103 6/1992 Minasy et al. ..... 340/551
5,304,982 4/1994 Cordery ..... 340/572

*Primary Examiner*—Glen Swann
*Attorney, Agent, or Firm*—Sixbey, Friedman, Leedom & Ferguson

[57] ABSTRACT

An electronic article surveillance system is provided having a transmitter for generating two alternating magnetic fields by way of a single transmitter coil fed with a transmitter signal current, and a receiver that detects harmonics and intermodulation products of the alternating magnetic fields by way of a receiver coil that generates a receiver signal current. The receiver comprises a wide-bandwidth phase detector locked on to a frequency $p.f_2 \pm q.f_1$, where p and q are positive integers, one of which may be zero, and a digital signal processor adapted to carry out a full time-domain analysis of the waveform of the receiver signal current, and wherein the transmitter signal current corresponds to the linear super position of two alternative currents with a relatively low frequency $f_1$ and high frequency $f_2$ respectively.

14 Claims, 3 Drawing Sheets

METHOD AND SYSTEM FOR DETECTING A MARKER

BACKGROUND OF THE INVENTION

This invention relates to a method of detecting a marker within a predetermined zone and to a system for carrying out the method. The invention is intended primarily to be used in the detection of goods in electronic article surveillance or anti-theft systems, but it may be used for example in article tracking or personnel detection systems.

The invention concerns the detection of markers which have specific non-linear characteristics. It is exemplified in relation to high permeability ferromagnetic markers, but it applies also to markers which have non-linear electronic circuit components.

Systems which are examples of this invention will provide for the excitation and interrogation of (receipt of information from) special markers, and the systems give better distinguishability in detection of these markers over commonplace 'false alarm' objects at minimum system complexity and cost, when compared to systems of the prior art. This leads to high positive detection probability and low false alarm probability.

The types of markers detected by these systems are well known in the prior art. They are usually ferromagnetic markers which have a very high magnetic permeability and low coercivity. This means that they exhibit magnetic saturation (and particularly a reproducible non-linear magnetic response) at very low levels of applied magnetic field (typically of order 1 Oersted). They are typically long narrow strips or thin films of special high permeability magnetic alloys.

In systems which detect these markers, an interrogating magnetic field is driven by a coil or set of coils. This varying magnetic field produces a varying state of magnetization in the marker which in turn re-emits a magnetic field. Because of the non-linearity of the marker, the re-emitted field contains frequency components such as harmonics and intermodulation products which are not present in the interrogating field. These components are detected by a coil or set of coils to indicate the presence of the marker.

The detection is made difficult because many commonplace objects are magnetic, such as tin cans, keys, shopping trollies, etc. These also have nonlinear characteristics of a greater or lesser degree, and also give rise to varying amounts of the new frequency components.

Many systems of the prior art have used an interrogating magnetic field of a single frequency $f_1$, and detected a harmonic component $n.f_1$. In order to discriminate between high-permeability markers and low-permeability common objects, these systems have detected high-order harmonics such as the 20th to 100th harmonic since high permeability materials emit proportionately more at these high orders than common objects. Generally, only the level of the high order harmonic is detected, so the systems are still very prone to false alarm. Some improvement is made by measuring the amount of more than one high order harmonic (usually 2) and confirming the ratio between the two (or more) levels. However, both of these types of system suffer the disadvantage that most of the marker energy is emitted at low harmonic rather than the high orders used for detection, so detectivity is low or else the markers have to be made large, expensive and cumbersome.

A better method exemplified in U.S. Pat. No. 3,990,065 is to use two frequencies, one low $f_1$, and one high $f_2$, and to detect an intermodulation product of these two frequencies: $f_2+2f_1$. The '065 patent shows use of a third frequency $f_3$ to scan the interrogation fields around in spatial orientation, but this is not material to the present application. The generation of signal at $f_2+2f_1$, is preferential to markers compared to common objects, and furthermore since this is a very low order intermodulation product, it contains a lot of energy for detection. The disadvantage of the '065 method is that once again only a single or narrow-band frequency is detected, so the information content of the signal is low. Furthermore since $f_1$ is very low compared to $f_2$, the detected frequency is very close to an emitted frequency $f_2$, which contains a lot of power, therefore emitter and receiver bandwidth have to be very narrow and carefully defined if the emitter is not to swamp the receiver with background signal. This places severe design constraints on the electronic circuitry.

Another system is shown in EP 0153286 of the present assignee. Here a low frequency $f_1$ is used, together with two further high frequencies $f_2$ and $f_3$. $f_2$ and $f_3$ are significantly different from each other, and are emitted from separate coils which are physically separated from each other. Detection is carried out around an intermodulation product frequency $n.f_2+m.f_3$ (usually $f_2+f_3$) in a frequency band which includes the sidebands of twice the low frequency $f_1$. This system has the advantage that the detected frequency is very far from any emitted frequency, so the filter design is eased. Furthermore, a large bandwidth around $n.f_2$ and $m.f_3$ is available (i.e. free from emitted signal), which is rich in intermodulation information which can be used to distinguish the presence of markers. The disadvantage of this system is the need for two coils, the need for generating three separate frequencies, and the consequent complexity in electronic and mechanical design. Furthermore, even the low order product $f_2+f_3$ is not the lowest available intermodulation frequency, so it has limited available energy.

SUMMARY OF THE INVENTION

In accordance with a first aspect, the present invention provides a method of detecting articles containing or carrying markers with a non-linear magnetic characteristic by passing the articles through a surveillance zone in which a first magnetic field of relatively low frequency $f_1$ and a second magnetic field of relatively high frequency $f_2$ are generated, and detecting the harmonic response of said markers; characterised in that:

(a) the harmonic response is detected in a frequency bandwidth $m.f_2 \pm n.f_1$, where n and m are positive integers, and m is greater than 1;

(b) the harmonic response is detected by phase-sensitive detection means which is locked onto a generated reference frequency $p.f_2 \pm q.f_1$, where p and q are positive integers, one of which may be zero; and (c) the harmonic response at the $n.f_1$ sidebands is analysed by digital signal processing means which activates an alarm if the shape and/or amplitude of the $n.f_1$ sidebands correspond to predetermined values.

By using two interrogation frequencies: a low frequency $f_1$ and a high frequency $f_2$, and detecting over the bandwidth that covers a number of intermodulation products $m.f_2+n.f_1$, it is possible to gain a great deal of information concerning the nature of the magnetic non-linearity of the object and hence to distinguish the special markers. In a preferred embodiment of the invention, detection of the intermodulation products takes place around the second harmonic of the high frequency, i.e. $2f_2 \pm n.f_1$ (where n represents several integers, preferably from 0 up to 40, e.g. from 0 up to 10, i.e. several intermodulation frequencies which are detected at the same time). Preferably, n is chosen so that the $n.f_1$ sidebands around neighbouring $m.f_2$ harmonics do not overlap (i.e. such that $m.f_2+n.f_1<(m+1).f_2-n.f_1$). The main advantages over the '286 system are that system implementation is simpler because of the reduced number of frequencies that are required to be driven, and that more detectable energy is emitted by the markers at this frequency band than in the '286 systems where the energy is spread over the bands $2f_2$, $f_2+f_3$, and $2f_3$. We have found that the signal in a system of our new invention is approximately 6 dB higher in amplitude than in a comparable '286 system.

By detecting a band of products $n.f_1$, around this harmonic, a system according to our invention detects a large amount of information relating to the complex and characteristic magnetic response of the high permeability markers at low field levels, compared to the more uniform behaviour of commonplace objects. Commonplace objects emit most of their energy in this band at close sidebands, while markers have their emitted energy spread over a much wider bandwidth including high order (up to 20th or higher) sidebands. This aspect of the invention is preferably implemented as a wide-bandwidth detection circuit centred on the second harmonic of the high frequency, with a full time-domain analysis of the received signal shape carried out, preferably by digital signal processing techniques. Particular use may be made of the cyclic nature of the signal; that is, cyclic at the bias frequency $f_1$. The characteristic shape of the signal arising from the special high-permeability markers is checked for a number of parameters before detection is confirmed. The advantages of this are that the characteristic signal shape of the special markers can be identified with a very high degree of certainty, so that there are very few false alarms in a system of this type. The signals can even be analyzed to distinguish one style of marker from another, so that inappropriate markers can be rejected. Furthermore, the marker signal shape can be picked out of a background signal generated by most commonplace objects so that markers can still be detected in the presence of other objects.

Advantageously, a quadrature detector comprising two mixers may be used. The mixers mix the detected signal with a generated reference signal $p.f_2 \pm q.f1$, where p and q are integers. The reference signal, which has a phase angle $\phi_R$, is mixed in one of the mixers with the detected signal, which has a phase angle $\phi_M$. Before reaching the second mixer, the detected and/or reference signal are dephased so that the phase difference is $\phi_R-\phi_M \pm 90°$. The quadrature detector may also comprise a low-pass filter in order to remove frequencies higher than that of the reference signal. The low frequency output of the quadrature detector contains information on the phase and amplitude of the intermodulation products.

The quadrature detector advantageously emits a signal on two channels, wherein the signal on the first channel corresponds to $A.\sin \phi$, where A is the amplitude of the detected signal and $\phi$ is $\phi_R-\phi_M$, and the signal on the second channel corresponds to $A.\cos \phi$. The values of A and $\phi$ for consecutive signal pulses in both channels may be analysed by a microprocessor which is arranged to trigger an alarm if there is a predetermined degree of similarity between successive signal pulses indicative of the presence of a marker in the surveillance zone.

In order further to reduce the likelihood of false alarms, the phase of the $f_1$ signal may be fed to the microprocessor which may be arranged to check whether the signal pulses occur in step with the $f_1$ signal. This allows the effect of external varying magnetic fields and other interference to be suppressed.

According to a second aspect of the present invention, there is provided a method of detecting articles containing or carrying markers with a non-linear magnetic characteristic by passing the articles through a surveillance zone in which a first magnetic field of relatively low frequency $f_1$ and a second magnetic field of relatively high frequency $f_2$ are generated, and detecting the harmonic response of said markers; characterised in that:

(a) the harmonic response is detected in a frequency bandwidth $m.f_2 \pm n.f_1$, where n and m are positive integers, and m is greater than 1; and (b) the amplitude of the first magnetic field is greater than that of the second magnetic field.

By making the amplitude of the second field lower than that of the first, the total magnetic field is reduced, and accordingly there is less inductive coupling with magnetic objects outside the surveillance zone. This means that the characteristic marker response is better defined against background noise and other interference. The amplitude of the first field is preferably from 1.0 to 5.0 Oersted, while that of the second field is preferably from 0.1 to 0.9 Oersted. Typical values are 2.0 Oe and 0.5 Oe respectively.

According to a third aspect of the present invention, there is provided a method of detecting articles containing or carrying markers with a non-linear magnetic characteristic by passing the articles through a surveillance zone in which a first magnetic field of relatively low frequency $f_1$ and a second magnetic field of relatively high frequency $f_2$ are generated, and detecting the harmonic response of said markers; characterised in that:

(a) the harmonic response is detected in a frequency bandwidth $m.f_2 \pm n.f_1$, where n and m are positive integers, and m is greater than 1; and (b) the ratio $f_2:f_1$ is greater than 150:1.

This high ratio has the advantage that the marker response signal is clearly defined, allowing for improved detection accuracy. The first frequency $f_1$ is preferably in the range 1 to 100 Hz, while the second frequency $f_2$ is preferably in the range 500 to 20,000 Hz. Typical frequencies are 16 Hz and 6.25 kHz respectively, giving a frequency ratio $f_2:f_1$ of 390:1.

According to a further aspect of the present invention, at least one of the low frequency field $f_1$ and the high frequency field $f_2$ has a non-sinusoidal waveform. In particular the low frequency field, which may be derived from a switched mode or synthesised power supply, may be simpler to generate as a more triangular waveform, i.e. contain odd harmonics of the fundamental frequency $f_1$. This does not adversely affect the method of detection.

According to another aspect of the present invention, the interrogating magnetic fields are generated by a single coil, fed by a current which represents the linear superposition of the two drive frequencies. The receiver coils may be incorporated in the same physical enclosure as the transmitter coil, leading to a system which has a single aerial pedestal as opposed to the two pedestals necessary in the '286 system and in most other magnetic anti-theft systems. This aspect is most advantageously implemented where the transmitter coil is physically large and spread out over a large area, rather than compact, since with a large coil the range of magnetic drive field amplitudes likely to be experienced by a marker is less, leading to a lower range of received marker signal strengths, which is simpler to process effectively.

BRIEF DESCRIPTION OF THE SEVERAL DRAWINGS

By way of illustration, a preferred embodiment will now be described with reference to the drawings.

DETAILED DESCRIPTION OF THE PREFERRED EMBODIMENT

Figure 1:
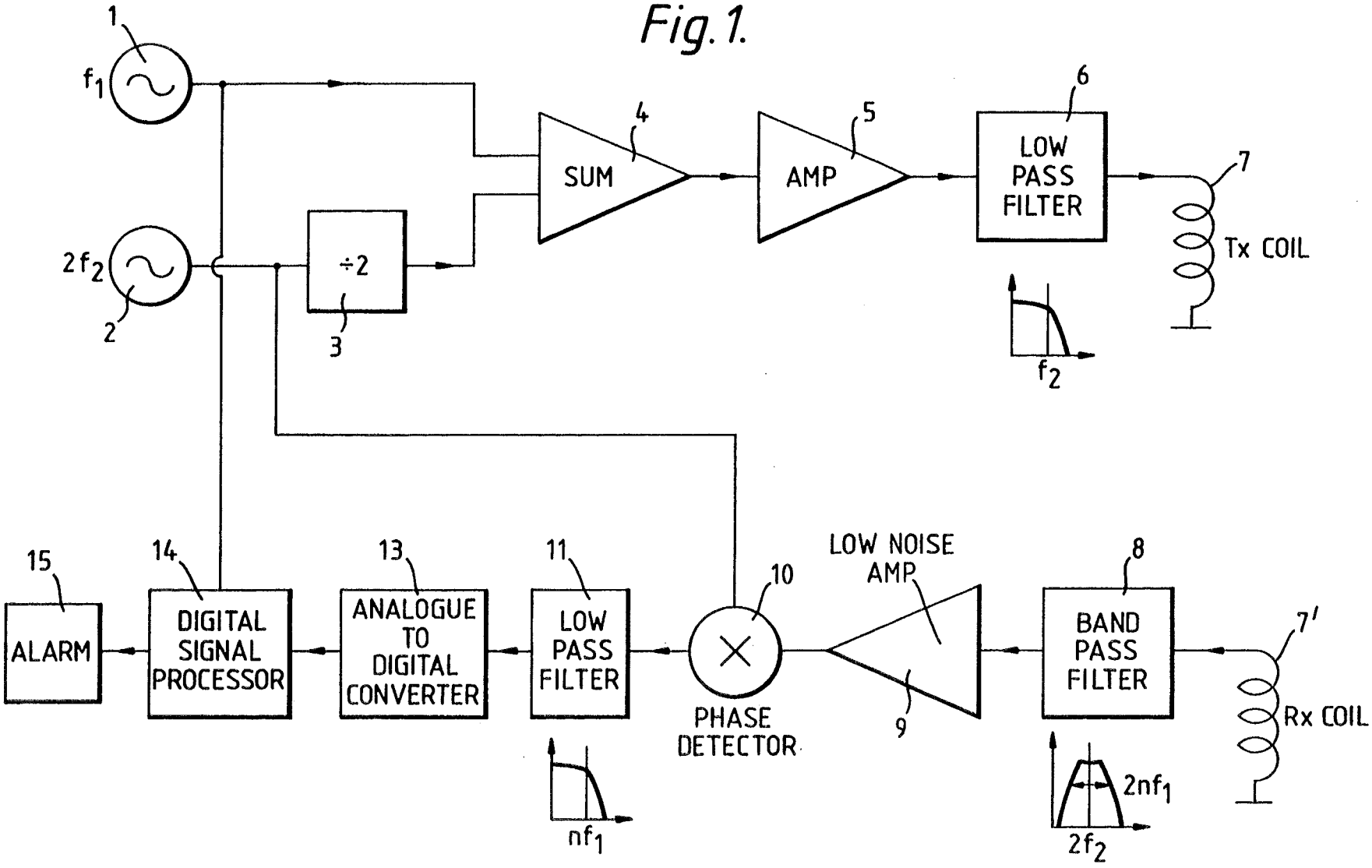
FIG. 1 is a schematic outline of the present invention.
Figure 2:
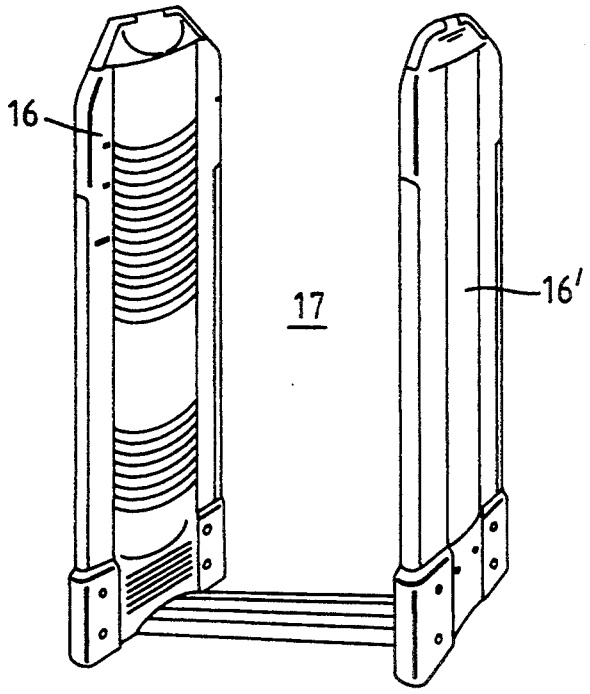
FIG. 2 shows an embodiment of the invention in which two pedestal antennae are used.
Figure 3:
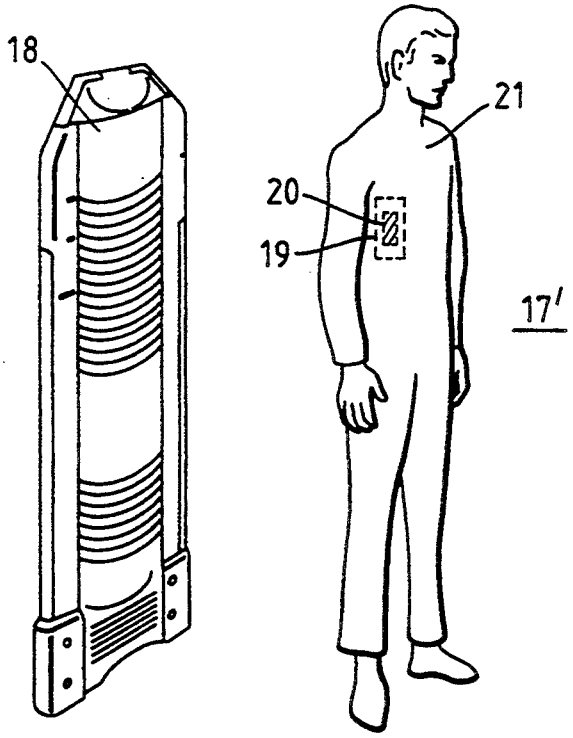
FIG. 3 shows an embodiment of the invention in which only a single pedestal antenna is used.

Turning now to FIG. 1, two alternating current sources 1 and 2, operating at frequencies $f_1$ and $2f_2$ respectively, are combined by way of summing amplifier 4, the frequency of current source 2 first being halved by frequency divider 3. The output of summing amplifier 4 is amplified by amplifier 5, and is passed through a low pass filter 6 with a cut-off frequency $f_2$ to a transmitter coil 7. The harmonic responses to the interrogation signal of markers present in the surveillance zone 17 in FIGS. 2 and 3 are received by a receiver coil 7', which may be the same coil as transmitter coil 7. Band pass filter 8 removes any signals received which fall outside the desired $2f_2 \pm n.f_1$ bandwidth, and passes the residual signal through low noise amplifier 9 to phase detector 10, which correlates the phase of the signal with that of current source 2. The signal is then passed through low pass filter 11 with a cut-off frequency $n.f_1$ to analogue-to-digital converter 13, and thence to digital signal processor 14, which analyses the signal for harmonic responses at the $n.f_1$ sidebands caused by the presence of a marker in the surveillance zone 17. This information is available as a time domain signal of a particular shape which repeats at the low frequency $f_1$. If the shape corresponds within acceptable bounds to a predetermined shape, then the alarm 15 is activated.

FIG. 2 shows two pedestal antennae 16 and 16' which together define a surveillance zone 17. In this embodiment of the invention, both pedestals 16 and 16' may contain transmitter and receiver coils 7 and 7', or alternatively the transmitter coil 7 may be housed in pedestal antenna 16 separately from the receiver coil 7' which is then housed in pedestal antenna 16'.

FIG. 3 depicts an embodiment of the invention in which the transmitter 7 and receiver 7' coils are the same. In this case, the combination coil may be housed in a single pedestal antenna 18, which has a surveillance zone generally indicated at 17'. A person 21 carrying an article 19 to which an active marker 20 is attached will cause alarm 15 to be activated when the marker 20 passes through the surveillance zone 17'.

Figure 4A:
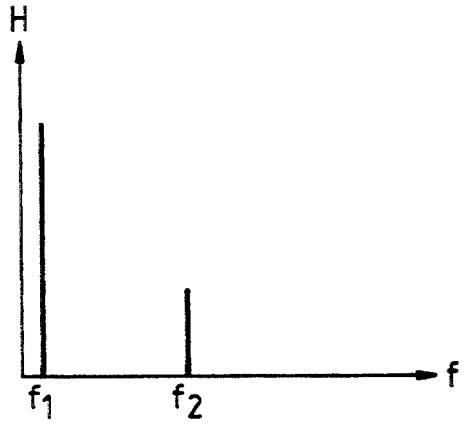
FIGS. 4*a* to 4*d* are graphs representing signals at different stages in the present invention.

FIG. 4*a* shows the amplitude H of the first and second transmitted magnetic fields plotted against their frequency. The amplitude of the second magnetic field is lower than that of the first.

Figure 4B:
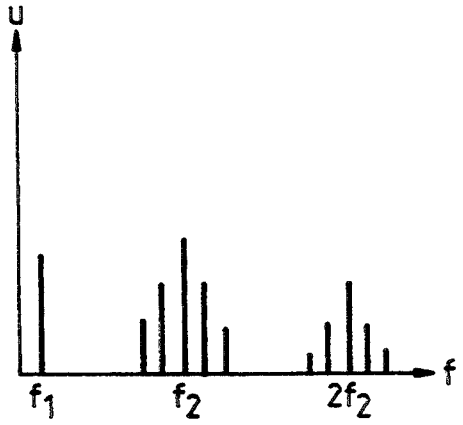
Figure 4C:
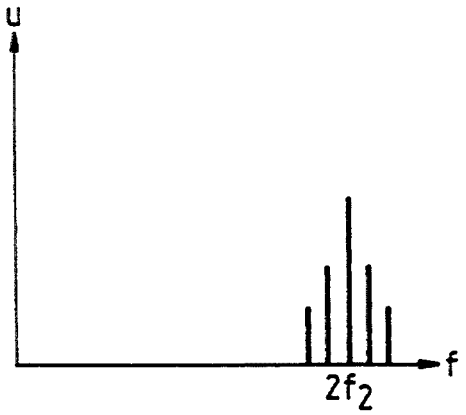
Figure 4D:
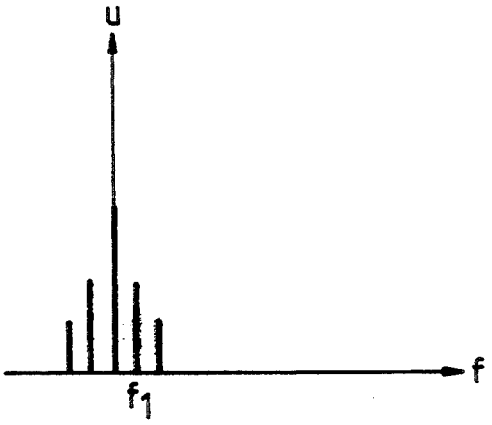

Because of its non-linear magnetisation curve, a magnetic marker excited by these transmitted frequencies produces intermodulation frequencies $m.f_2 \pm n.f_1$. These are received by the receiver coil 7' and induce potential difference pulses as shown in FIG. 4*b*. Only frequencies around $2.f_2$ may pass through the band pass filter 8, as shown in FIG. 4*c*. The phase detector 10 multiplies these signals with a signal corresponding to $\exp(4\pi i.f_2)$ in order to shift down the signal frequency by $2f_2$, as shown in FIG. 4*d*. The negative frequencies in FIG. 4*d* represent phase information. The relatively low $n.f_1$ frequencies of FIG. 4*d* are easily digitised and analysed by the digital signal processor 14. In the event that the amplitudes of the sidebands and/or the ratios between adjacent sidebands (equivalent to the shape of the sideband spectrum) exceed a predetermined value, the digital signal processor 14 is arranged to activate the alarm 15.

We claim:

1. A method of detecting articles containing or carrying markers with a non-linear magnetic characteristic by passing the articles through a surveillance zone in which a first magnetic field of relatively low frequency $f_1$ and a second magnetic field of relatively high frequency $f_2$ are generated, and detecting the harmonic response of said markers; characterised in that:

(a) the harmonic response is detected in a frequency bandwidth $m.f_2 \pm n.f_1$, where n and m are positive integers, and m is greater than 1;

(b) the harmonic response is detected by phase-sensitive detection means which is locked onto a generated reference frequency $p.f_2 \pm q.f_1$, where p and q are positive integers, one of which may be zero; and (c) the harmonic response at the $n.f_1$ sidebands is analysed by digital signal processing means which activates an alarm if the shape and/or amplitude of the $n.f_1$ sidebands correspond to predetermined values.

2. A method according to claim 1, wherein at least one of the low frequency $f_1$ and the high frequency $f_2$ magnetic fields has a non-sinusoidal waveform.

3. A method according to claim 2, wherein said waveform is generally triangular.

4. A method according to claim 3, wherein the low frequency magnetic field contains odd harmonics of the fundamental frequency $f_1$.

5. A method of detecting articles containing or carrying markers with a non-linear magnetic characteristic by passing the articles through a surveillance zone in which a first magnetic field of relatively low frequency $f_1$ and a second magnetic field of relatively high frequency $f_2$ are generated, and detecting the harmonic response of said markers; characterised in that:

(a) the harmonic response is detected in a frequency bandwidth $m.f_2 \pm n.f_1$, where n and m are positive integers, and m is greater than 1; and (b) the amplitude of the first magnetic field is greater than that of the second magnetic field.

6. A method according to claim 5, wherein m is 2 and wherein n represents one or more integers selected from the range 0 to 40 inclusive.

7. A method according to claim 5, wherein $m.f_2+n.f_1$ is less than $(m+1).f_2-n.f_1$.

8. A method according to claim 5, wherein the amplitude of the first magnetic field is in the range 1.0 to 5.0 Oersted and the amplitude of the second magnetic field is in the range 0.1 to 0.9 Oersted.

9. A method of detecting articles containing or carrying markers with a non-linear magnetic characteristic by passing the articles through a surveillance zone in which a first magnetic field of relatively low frequency $f_1$ and a second magnetic field of relatively high frequency $f_2$ are generated, and detecting the harmonic response of said markers; characterised in that:

(a) the harmonic response is detected in a frequency bandwidth $m.f_2 \pm n.f_1$, where n and m are positive integers, and m is greater than 1; and (b) the ratio $f_2:f_1$ is greater than 150:1.

10. An electronic article surveillance system, which system comprises a transmitter which generates two alternating magnetic fields via a single transmitter coil which is fed with a transmitter signal current and a receiver which detects harmonics and intermodulation products of said alternating magnetic fields via a receiver coil which generates a receiver signal current, wherein the receiver comprises a wide-bandwidth phase detector locked onto a frequency $p.f_2+q.f_1$, where p and q are positive integers, one of which may be zero, and a digital signal processor adapted to carry out a full time-domain analysis of the waveform of the receiver signal current and wherein the transmitter signal current corresponds to the linear superposition of two alternative currents with respectively a relatively low frequency $f_1$ and a relatively high frequency $f_2$.

11. A system as claimed in claim 10, wherein the transmitter coil and the receiver coil are incorporated in a single housing.

12. A system as claimed in claim 10 or 11, wherein the transmitter coil and the receiver coil are wound as a single unit.

13. A system as claimed in claim 10 or 11, wherein the area enclosed by the transmitter coil extends over that enclosed by the receiver coil.

14. A system as claimed in claim 10, wherein the phase detector is locked onto a frequency $2.f_2$.

* * * * *